US012655731B2

(12) United States Patent
Ayub et al.

(10) Patent No.: US 12,655,731 B2
(45) Date of Patent: Jun. 16, 2026

(54) SMART PRESSURE DRIVEN AUTOMATED FLUID INJECTION MANAGEMENT SYSTEM AND METHOD

(71) Applicant: SAUDI ARABIAN OIL COMPANY, Dhahran (SA)

(72) Inventors: Jibran Ayub, Dhahran (SA); Shahid Manzoor, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 384 days.

(21) Appl. No.: 18/451,763

(22) Filed: Aug. 17, 2023

(65) Prior Publication Data

US 2025/0059862 A1 Feb. 20, 2025

(51) Int. Cl.
*E21B 43/16* (2006.01)
*E21B 47/06* (2012.01)

(52) U.S. Cl.
CPC ..... *E21B 43/166* (2013.01); *E21B 43/164* (2013.01); *E21B 47/06* (2013.01)

(58) Field of Classification Search
None
See application file for complete search history.

(56) References Cited

U.S. PATENT DOCUMENTS 4,042,029 A * 8/1977 Offeringa ..... E21B 43/164 166/305.1
8,271,247 B2 9/2012 Davidson
10,364,655 B2 7/2019 Patel et al.
10,883,339 B2 1/2021 Shaker et al.
11,111,784 B2 9/2021 Willberg et al.
2012/0003043 A1* 1/2012 Cawley ..... E21B 43/164 405/53
2012/0205127 A1* 8/2012 Gittins ..... E03B 3/12 166/90.1
2020/0003027 A1* 1/2020 Shaker ..... E21B 41/00
(Continued)

FOREIGN PATENT DOCUMENTS

CN 112101710 A 12/2020

OTHER PUBLICATIONS

Sun, K., and M. R. Konopczynski. "Prediction of Injection-Fluid Distributions for Multiple Zones-Intelligent Injection System." Paper presented at the SPE Annual Technical Conference and Exhibition, San Antonio, Texas, USA, Sep. 2006. doi: https://doi.org/10.2118/103078-MS (Year: 2006).*
(Continued)

*Primary Examiner* — Lina Cordero
(74) *Attorney, Agent, or Firm* — Vorys, Sater, Seymour and Pease LLP

(57) ABSTRACT

A method for allocating optimum fluid volume among a set of injectors of a hydrocarbon reservoir includes, for each of multiple depletion stages of the reservoir, determining reservoir pressure at a first region, corresponding to a first injector, in relation to average field reservoir pressure, determining reservoir pressure at a second region, corresponding to a second injector, in relation to average field reservoir pressure, and injecting fluid through the first and second injectors independently and as a function of the determined reservoir pressures at the first and second regions respectively.

20 Claims, 7 Drawing Sheets

(56) References Cited

U.S. PATENT DOCUMENTS

2021/0372246 A1 12/2021 Thakur et al.

OTHER PUBLICATIONS

Todd, M. R., Claridge, E. L., Rodriguez, R. A., and M. Prats. "Numerical Simulation Study of Gas Injection in the Lower Lagunillas Reservoir, Block III/IV, Lake Maracaibo." SPE Advanced Technology Series 2 (1994): 169-178. doi: https://doi.org/10.2118/23719-PA (Year: 1994).*

Agudelo, O. C., Acosta, T. J., Tellez-Mejia, C. E., Gonzalez-Bello, P.. , Navas, E. E., Duran, J. P., and J .. Porlles. "Casabe: Water Injection Optimization and Surveillance in a Mature Field." Paper presented at the SPE Trinidad and Tobago Section Energy Resources Conference, Port of Spain, Trinidad and Tobago, Jun. 2016.

Chan, Keng Seng, Kifli, Azmukiff Muhammed, and Nasir B. Darman. "Breaking Oil Recovery Limit in Malaysian Thin Oil Rim Reservoirs: Water Injection Optimization." Paper presented at the International Petroleum Technology Conference, Bangkok, Thailand, Nov. 2011.

Raslan, Mohammed S., and Ahmad J. Sultan. "Water Injection Optimization Using Streamlines from a Finite-Difference Simulator: A Case Study of a Middle East Field." Paper presented at the SPE Saudi Arabia Section Technical Symposium and Exhibition, Al-Khobar, Saudi Arabia, Apr. 2012.

* cited by examiner

SMART PRESSURE DRIVEN AUTOMATED FLUID INJECTION MANAGEMENT SYSTEM AND METHOD

FIELD OF THE DISCLOSURE

The present disclosure relates generally to tertiary hydrocarbon recovery, and more particularly, to gas/water injection pressure management to achieve controlled and uniform pressure distribution across the reservoir and prevent cusping and coning.

BACKGROUND OF THE DISCLOSURE

One of the main challenges in oil fields with produced gas/water re-injection is the strategy to allocate optimum fluid volume among existing injectors. The simple, conventional method is to inject equally among all injectors. However, this may create uneven pressure distribution, leading to cusping and/or coning in certain wells, which reduces efficiency and increases cost.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method for allocating optimum fluid volume among a set of injectors of a hydrocarbon reservoir includes, for each of multiple depletion stages of the reservoir, determining reservoir pressure at a first region, corresponding to a first injector, in relation to average field reservoir pressure, determining reservoir pressure at a second region, corresponding to a second injector, in relation to average field reservoir pressure, and injecting fluid through the first and second injectors independently and as a function of the determined reservoir pressures at the first and second regions respectively.

In another embodiment, a hydrocarbon reservoir pressure management system includes a plurality of injectors each associated with at least one region of a field of a hydrocarbon reservoir, a pressure injection controller configured to receive as inputs physical data and measurement data in connection with the reservoir, and a balancer operable to, at successive reservoir depletion stages, determine from the physical data and measurement data reservoir pressures at first and second regions in relation to average field reservoir pressure, and independently drive injection volumes of first and second injectors, respectively corresponding to first and second regions, based on the determined reservoir pressures.

In a further embodiment, a machine-readable storage medium having stored thereon a computer program for allocating optimum fluid volume among a set of injectors of a hydrocarbon reservoir, the computer program comprising a routine of set instructions for causing the machine to perform the steps of, for each of multiple depletion stages of the reservoir, determining reservoir pressure at a first region, corresponding to a first injector, in relation to average field reservoir pressure, determining reservoir pressure at a second region, corresponding to a second injector, in relation to average field reservoir pressure and injecting fluid through the first and second injectors independently and as a function of the determined reservoir pressures at the first and second regions respectively.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
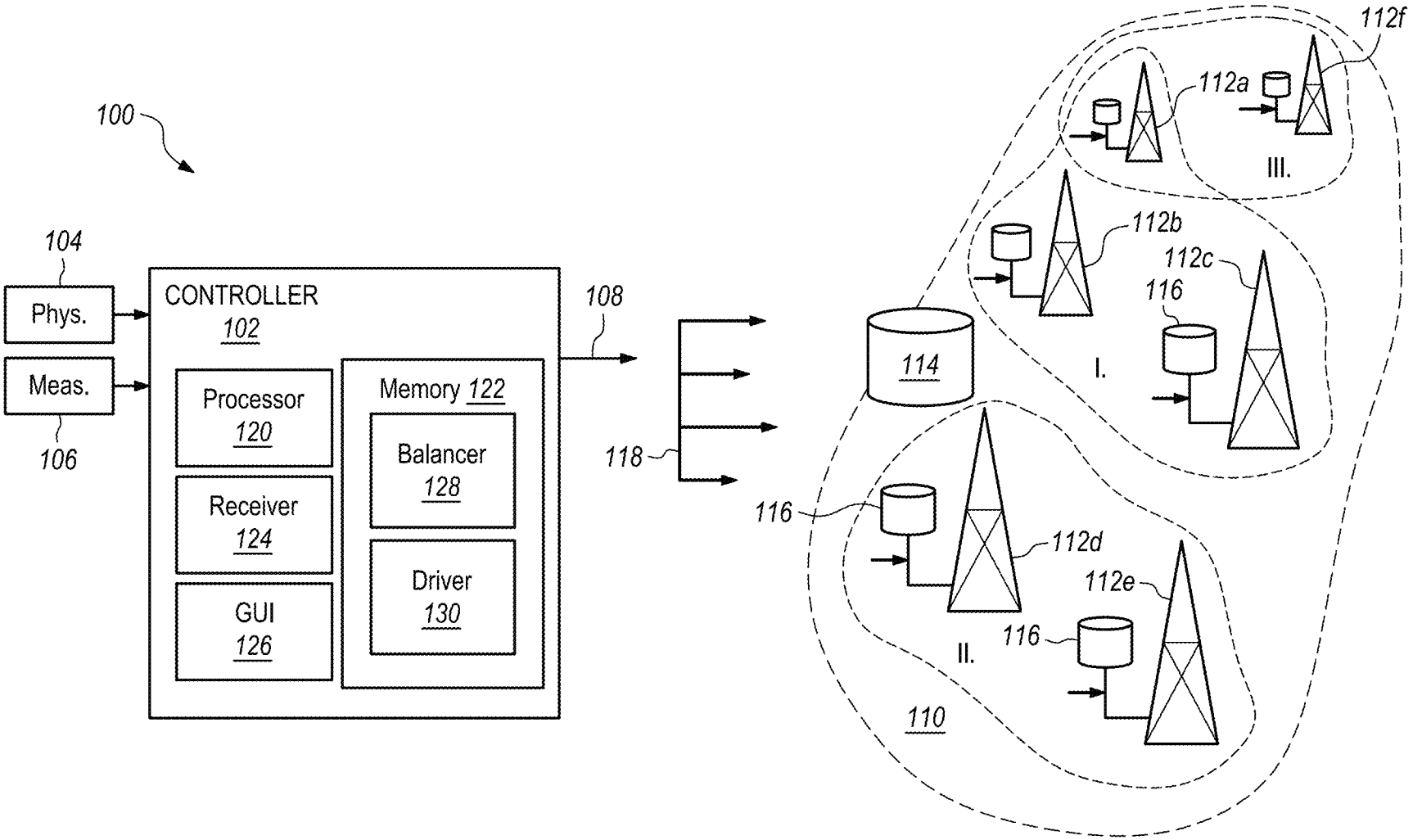
FIG. 1 is a block diagram of a hydrocarbon reservoir pressure management system used to allocate optimum fluid volume among injectors of a hydrocarbon reservoir in accordance with certain embodiments.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to tertiary hydrocarbon recovery, and more particularly, to gas/water injection pressure management to achieve controlled and uniform pressure distribution across the reservoir and prevent cusping and coning.

FIG. 1 is a block diagram of a hydrocarbon reservoir pressure management system 100 used to allocate optimum fluid volume among injectors of a hydrocarbon reservoir in accordance with certain embodiments. System 100 may be deployed to balance pressure throughout the hydrocarbon reservoir during the producing life of a field, and can effectively reduce water or gas coning and/or cusping during tertiary hydrocarbon production.

System 100 includes a pressure injection controller 102 configured to receive as inputs physical data 104 and measurement data 106 in connection with a hydrocarbon reservoir formation (not shown), and to output injection rate signals 108 to selectively control operation of injectors 112, as further detailed below. A hydrocarbon field 110 associated with the reservoir formation lies on the Earth's surface and contains the injectors 112 that are controlled by system 100. However, the principles described herein are equally applicable to an undersea hydrocarbon reservoir formation.

Field 110 includes regions I, II and III, and each of these regions contains one or more of the injectors 112 (individually, 112*a-f*). Region I contains injectors 112*a-c*; region II contains injectors 112*d-e*; and region III contains injectors 112*f* and 112*a* (which is common to both regions I and III). More or fewer regions or injectors, and injectors per region, than described herein, are contemplated.

Injectors 112 are operable to inject into the reservoir, through respective wellbores (not shown), gas such as nitrogen or carbon dioxide, or liquid such as water or brine, in order to controllably increase the pressure in the reservoir and enhance hydrocarbon recovery. The injected gas or liquid, which may generally be referred to herein as "fluid," may be sourced from a centralized tank 114 and piped to the individual injectors 112 at an individually controlled rate and volume for each injector or group of injectors; or it may be sourced from distributed tanks 116 each dedicated to a subset of one or more injectors 112, with each subset corresponding to one of the areas I, II, or III for example.

System 100 includes a configurable distribution network 118 that is operable to selectively control gas or liquid (i.e., fluid) flow from the centralized tank 114 or the distributed tanks 116 to the injectors 110 in a controlled manner as a function of the injection rate signals 108 issued by pressure injection controller 102. The injection rate signals 108 serve to configure the distribution network in accordance with a desired injection profile, for example selectively actuating valves and solenoids in the appropriately pressurized distribution network 118 to increase or decrease flow from the tank 114 or tanks 116 to the various injectors 112 as necessary to achieve a desired pressure outcome at each of the injectors.

The injection profile configured into the distribution network 118 is dynamically-controlled by the pressure injection controller 102 by operation of processor 120 executing various modules in memory 122 based on the physical data 104 and measurement data 106 received by data receiver 124. Although described in terms of a software, however, it is contemplated that the modules can be in hardware form, or a combination of hardware and software. Physical data 104 can include information about quality and heterogeneity of the reservoir formation, and location and potential of the gas injectors 112 for example. It may also include rock properties, i.e., permeability, porosity, pore-volume, and well (geometric) indices etc. that are relevant physical properties. Measurement data 106 can include real-time or dynamic measurement information, and relates to regional reservoir depletion status (such as for regions I, II, and III), static pressure at the injectors 112 and at various regions I, II, and III, average field reservoir pressure at each depletion stage, and so on. It can also include real time (calculated/updated every time step) moles (production and/or injection), pressure, saturation, potential, and drawdown. It will be appreciated that the term "real-time" can denote incremental or timestep updates—for example at regular intervals such as once every hour, once per day, and so on—and does not necessarily denote a continuous process, although that is contemplated as well.

Receiver 124 can also function to receive signals from various in situ sensors such as those for measuring bottom-hole static pressure at the various injector 112 locations and/or regions I, II, and III for instance, or to provide temperature measurements, and other relevant information. The physical data 104 and measurement data 106 may be received by receiver 124 wirelessly or through cables (not shown), or any combination of these expedients. Pressure injection controller 102 may include a graphical user interface 126 allowing an operator to enter some or all of this data, as well as operational parameters and programming, testing and calibration features and commands for the system for instance.

Operation of pressure injection controller 102 is primarily by way of a balancer 128, which, like the other modules, may be a hardware or software component, or a combination of these, and which is configured to execute a pressure balancing algorithm using the physical data 104 and measurement data 106 received as inputs by pressure injection controller 102, and to issue the injection rate signals 108 as outputs by way of a driver 130. The reservoir pressure balancing algorithm for gas/water injection (or re-injection) optimally allocates gas/water volumes not only based on injection potential of the injectors 112, but also taking reservoir pressure and depletion state of areas proximate to the injectors, which may be the areas I, II, and III, into account. Thus balancer 128 determines reservoir pressure at various regions in relation to overall reservoir pressure at each stage of depletion, and independently adjusts injection rates and/or volumes to locally control pressure and reduce cusping/coning. This approach is operable to achieve controlled and uniform pressure distribution across the reservoir. In certain embodiments, balancer 128 operates at each successive depletion stage of the reservoir (or a localized portion of the reservoir) to configure the injection profile of the distribution network 118 such that the injection rate for the active injectors 112 is allocated depending on the difference between the reservoir pressure surrounding the injectors (for example in a region I, II, or III, or in a more localized sub-region of these regions) and the average field reservoir pressure. For example, more gas/water is allocated for the injectors 112 in low pressure area, and less gas/water is allocated in high pressure areas.

The pressure balancing algorithm implemented by balancer 128 uses several parameters in designing an optimum gas injection strategy, including quality and heterogeneity of the reservoir formation, location and potential of the gas injectors, static well pressure measurements of injectors, and regional reservoir depletion status. The following equation represents the manner in which this identification of areas of low pressure and allocation of injection rates to balance the reservoir pressure is achieved by the balancer 128:

$$f = A \times e^{B \times \left(\frac{Pres}{Pswp}\right)^C} \quad \text{(Eq 1)}$$

Where f: is a factor proportional to the allocated gas or water injection

A: first pressure balance coefficient

B: second pressure balance coefficient

C: third pressure balance coefficient

Pres: reservoir average pressure

Pswp: static well pressure for the injectors

The algorithm facilitates balancing the reservoir pressure across the field i.e. increases the reservoir pressure in low pressure area and avoids over pressurizing certain areas of the reservoir. Three control parameters. A, B, and C in the above equation, can be changed to further enhance the pressure balancing in the reservoir. The parameters A, B, and C can be tuned to balance pressure in the reservoir.

Figure 2:
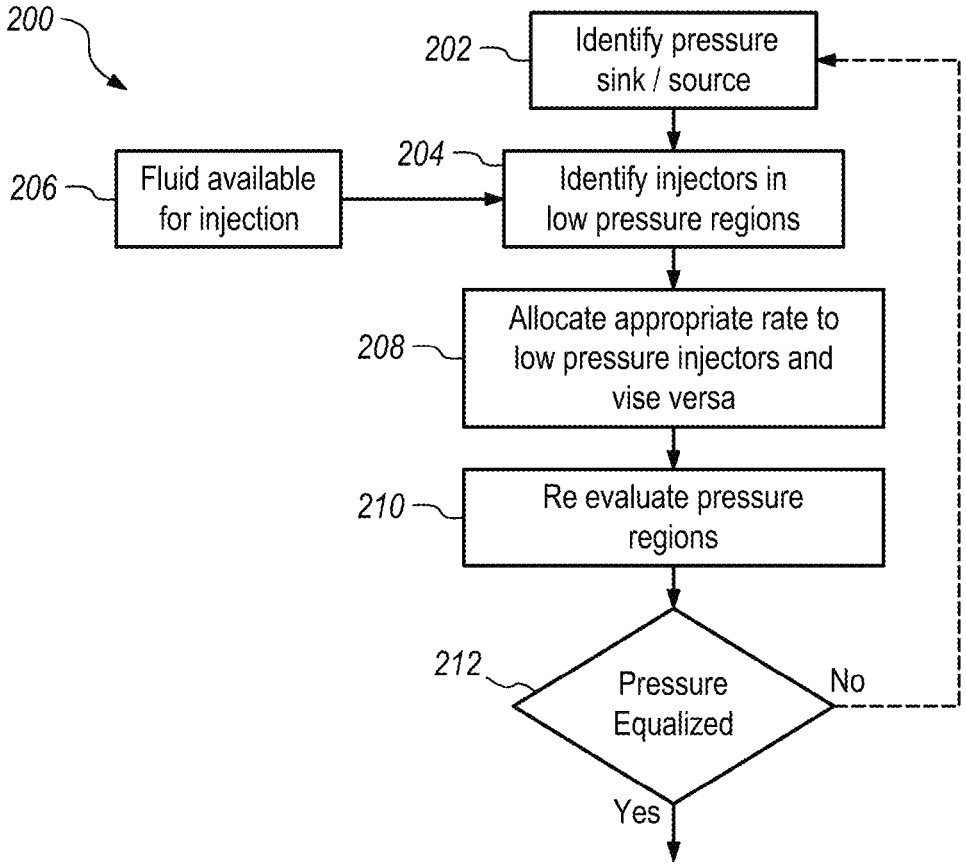
FIG. 2 is a flow diagram of a method for implementing hydrocarbon reservoir pressure management used to allocate optimum fluid volume among injectors of a hydrocarbon reservoir in accordance with certain embodiments.

FIG. 2 is a flow diagram of a method 200 for implementing hydrocarbon reservoir pressure management used to allocate optimum fluid volume among injectors of a hydrocarbon reservoir in accordance with certain embodiments. While, for purposes of simplicity of explanation, the example method of FIG. 2 is shown and described as executing serially, it is to be understood and appreciated that the present examples are not limited by the illustrated order, as some actions could in other examples occur in different orders, multiple times and/or concurrently from that shown and described herein. Moreover, it is not necessary that all described actions be performed to implement the methods, and conversely, some actions may be performed that are omitted from the description.

The method 200 may be used in a closed system to limit gas/fluid make up, relying on recycling instead, but this is not by way of limitation. At 202 pressure readings at the various injectors 112 (FIG. 1) are obtained, for example based on pressure around the wells with which the injectors are associated. At 204, injectors 112 representing low (and high) pressure sources/sinks are identified and fluid availability determined at 206. At 208, balancer 128 (FIG. 1) calculates the allocation rates required for particular injectors 112 to balance the reservoir pressure, and the appropriate injection profile of distribution network 118 is established. At 210, the pressure balancing versus allocation injector rates is performed for example at every timestep or based on specified time frequency, to establish the appropriate injection profile of distribution network 118. At 212, if reservoir pressure balancing is not achieved, flow returns to 202, to obtain pressure readings and repeat the process.

Figure 3A:
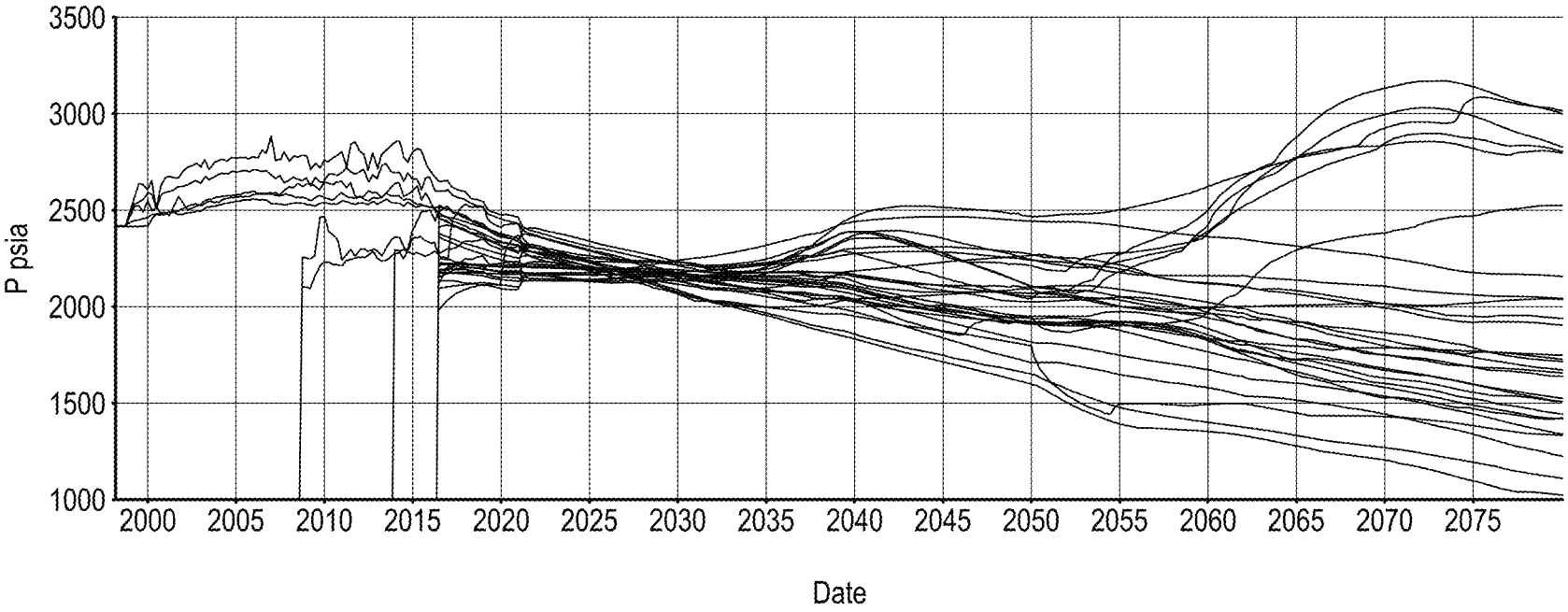
FIGS. 3A and 3B are plots showing a synthetic case before (FIG. 3A) balancing of reservoir pressure, and after (FIG. 3B) successful balancing in accordance with certain embodiments.
Figure 3B:
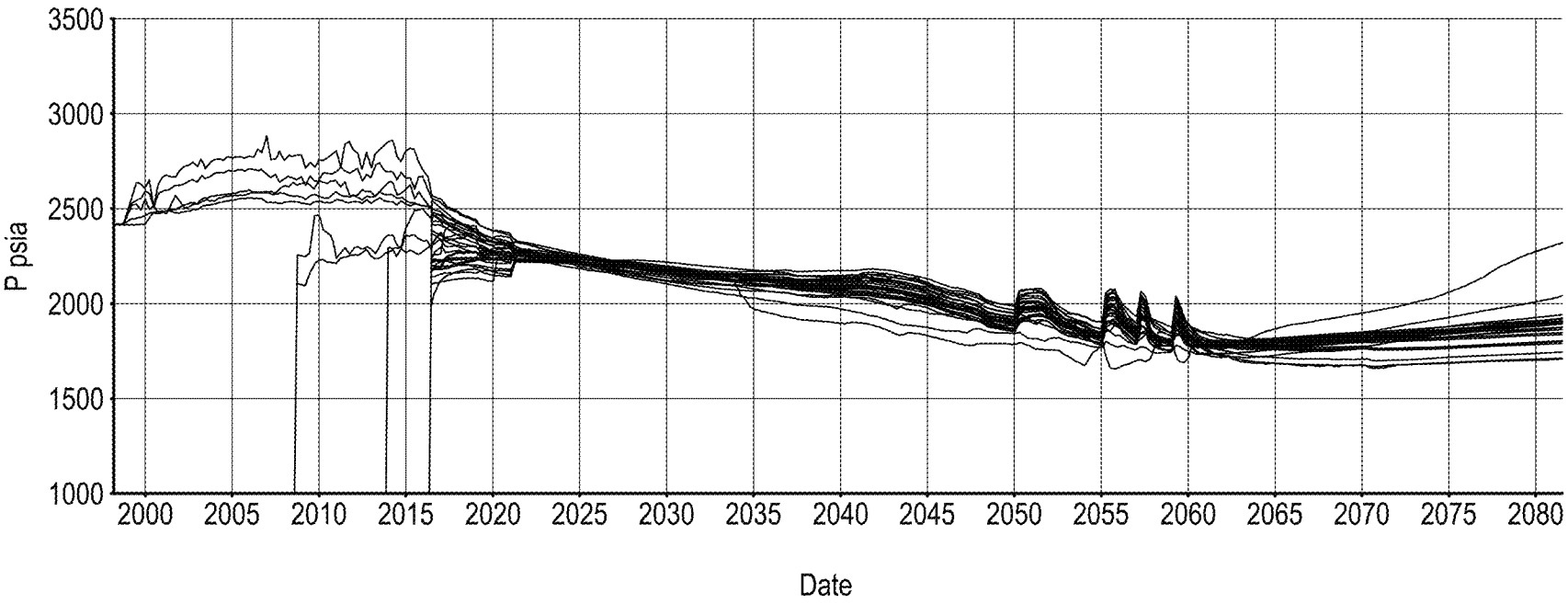

FIGS. 3A and 3B are plots showing a synthetic case before (FIG. 3A) balancing of reservoir pressure, and after (FIG. 3B) successful balancing in accordance with certain embodiments. In FIG. 3A, before balancing, with surrounding reservoir pressure not considered in target injection rates, the bottomhole static pressures are observed to have a wide range of pressure i.e. approximately around 2000 psi.

Figure 4A:
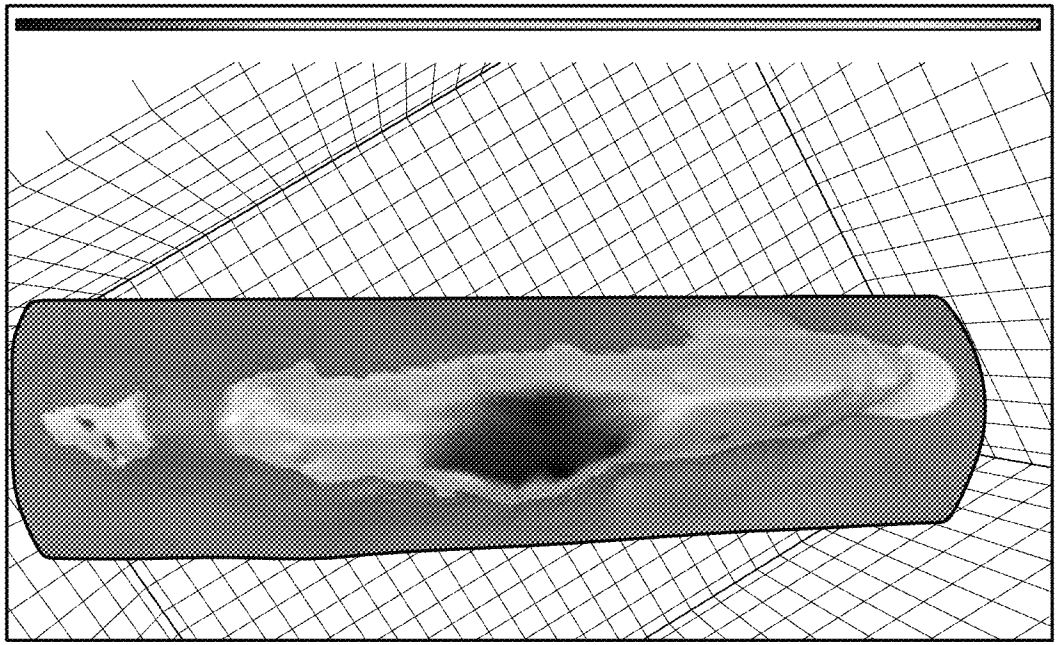
FIGS. 4A and 4B are pressure heat maps shown in 3-D and corresponding to FIGS. 3A and 3B respectively.
Figure 4B:
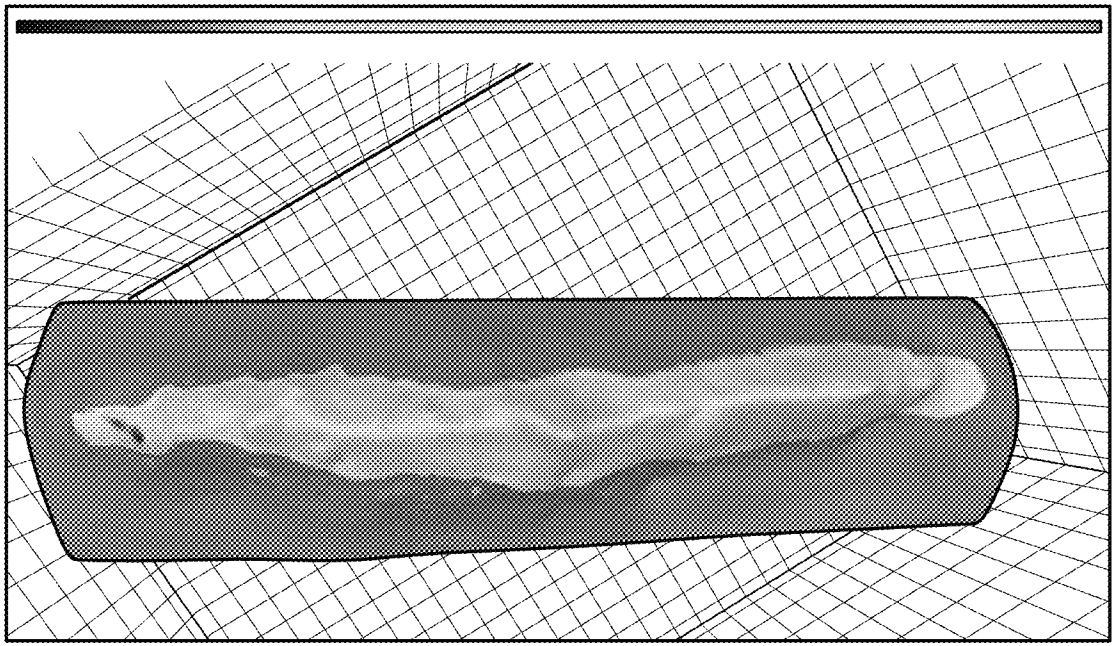

FIGS. 4A and 4B are pressure heat maps shown in 3-D and corresponding to FIGS. 3A and 3B respectively. In FIG. 4A, showing the pre-balancing configuration, high and low pressure regions can be discerned and a significant variation observed. FIG. 4B, in contrast, shows the pressure variation reduction attributable to the successful application of the balancing schemes of the instant description.

Important advantages of balancing as described herein is the reduction of cusping/coning, and a concomitant improvement in hydrocarbon production from the reservoir. In addition, average pressure variation around injectors 112 was reduced and a significant increase in the field reservoir pressure was observed resulting in lower gas production rate and GOR (gas/oil ratio) in gas injection schemes. Furthermore, it was observed that the gas injector efficiencies have been improved and a strong correlation was found between oil production rate and the allocated gas injection volumes for different areas of the field.

In view of the foregoing structural and functional description, those skilled in the art will appreciate that portions of the embodiments may be embodied as a method, data processing system, or computer program product. Accordingly, these portions of the present embodiments may take the form of an entirely hardware embodiment, an entirely software embodiment, or an embodiment combining software and hardware, such as shown and described with respect to the computer system of FIG. 5. Furthermore, portions of the embodiments may be a computer program product on a computer-readable storage medium having computer readable program code on the medium. Any non-transitory, tangible storage media possessing structure may be utilized including, but not limited to, static and dynamic storage devices, volatile and non-volatile memories, hard disks, optical storage devices, and magnetic storage devices, but excludes any medium that is not eligible for patent protection under 35 U.S.C. § 101 (such as a propagating electrical or electromagnetic signals per se). As an example and not by way of limitation, computer-readable storage media may include a semiconductor-based circuit or device or other IC (such, as for example, a field-programmable gate array (FPGA) or an ASIC), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. A computer-readable non-transitory storage medium may be volatile, nonvolatile, or a combination of volatile and non-volatile, as appropriate.

Certain embodiments have also been described herein with reference to block illustrations of methods, systems, and computer program products. It will be understood that blocks and/or combinations of blocks in the illustrations, as well as methods or steps or acts or processes described herein, can be implemented by a computer program comprising a routine of set instructions stored in a machine-readable storage medium as described herein. These instructions may be provided to one or more processors of a general purpose computer, special purpose computer, or other programmable data processing apparatus (or a combination of devices and circuits) to produce a machine, such that the instructions of the machine, when executed by the processor, implement the functions specified in the block or blocks, or in the acts, steps, methods and processes described herein.

These processor-executable instructions may also be stored in computer-readable memory that can direct a computer or other programmable data processing apparatus to function in a particular manner, such that the instructions stored in the computer-readable memory result in an article of manufacture including instructions which implement the function specified. The computer program instructions may also be loaded onto a computer or other programmable data processing apparatus to cause a series of operational steps to be performed on the computer or other programmable apparatus to realize a computer implemented process such that the instructions which execute on the computer or other programmable apparatus provide steps for implementing the functions specified in flowchart blocks that may be described herein.

Figure 5:
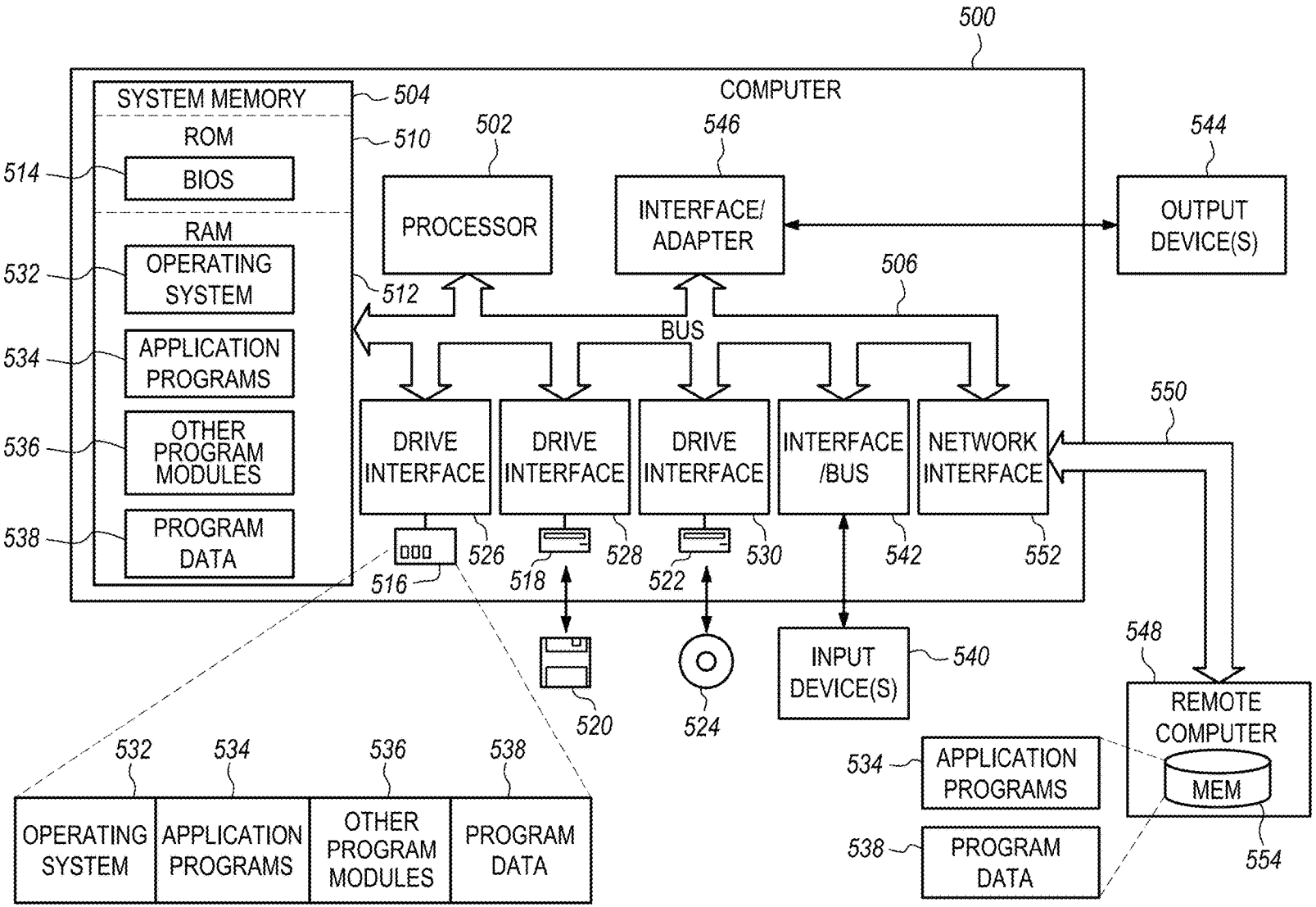
FIG. 5 illustrates one example of a computer system that can be employed to execute one or more embodiments of the present disclosure.

In this regard. FIG. 5 illustrates one example of a computer system 500 that can be employed to execute one or more embodiments of the present disclosure. Computer system 500 can be implemented on one or more general purpose networked computer systems, embedded computer systems, routers, switches, server devices, client devices, various intermediate devices/nodes or standalone computer systems. Additionally, computer system 500 can be implemented on various mobile clients such as, for example, a personal digital assistant (PDA), laptop computer, pager, and the like, provided it includes sufficient processing capabilities.

Computer system 500 includes processing unit 502, system memory 504, and system bus 506 that couples various system components, including the system memory 504, to processing unit 502. System memory 504 can include volatile (e.g. RAM, DRAM, SDRAM, Double Data Rate (DDR) RAM, etc.) and non-volatile (e.g. Flash, NAND, etc.) memory. Dual microprocessors and other multi-processor architectures also can be used as processing unit 502. System bus 506 may be any of several types of bus structure including a memory bus or memory controller, a peripheral bus, and a local bus using any of a variety of bus architectures. System memory 504 includes read only memory (ROM) 510 and random access memory (RAM) 512. A basic input/output system (BIOS) 514 can reside in ROM 510 containing the basic routines that help to transfer information among elements within computer system 500.

Computer system 500 can include a hard disk drive 516, magnetic disk drive 518, e.g., to read from or write to removable disk 520, and an optical disk drive 522, e.g., for reading CD-ROM disk 524 or to read from or write to other optical media. Hard disk drive 516, magnetic disk drive 518, and optical disk drive 522 are connected to system bus 506 by a hard disk drive interface 526, a magnetic disk drive interface 528, and an optical drive interface 530, respectively. The drives and associated computer-readable media provide nonvolatile storage of data, data structures, and computer-executable instructions for computer system 500. Although the description of computer-readable media above refers to a hard disk, a removable magnetic disk and a CD, other types of media that are readable by a computer, such as magnetic cassettes, flash memory cards, digital video disks and the like, in a variety of forms, may also be used in the operating environment; further, any such media may contain computer-executable instructions for implementing one or more parts of embodiments shown and described herein.

A number of program modules may be stored in drives and RAM 512, including operating system 532, one or more application programs 534, other program modules 536, and program data 538. In some examples, the application programs 534 can include balancer 128 and driver 130 for instance, and the program data 538 can include the received physical data 104 and measurement data 106. The application programs 534 and program data 538 can include functions and methods programmed to implement hydrocarbon reservoir pressure management in accordance with certain embodiments, such as shown and described herein.

A user may enter commands and information into computer system 500 through one or more input devices 540, such as a pointing device (e.g., a mouse, touch screen), keyboard, microphone, joystick, game pad, scanner, and the like. For instance, the user can employ input device 540 to edit or modify the "real time" measurement intervals. These and other input devices 540 are often connected to processing unit 502 through a corresponding port interface 542 that is coupled to the system bus, but may be connected by other interfaces, such as a parallel port, serial port, or universal serial bus (USB). One or more output devices 544 (e.g., display, a monitor, printer, projector, or other type of displaying device) is also connected to system bus 506 via interface 546, such as a video adapter.

Computer system 500 may operate in a networked environment using logical connections to one or more remote computers, such as remote computer 548. Remote computer 548 may be a workstation, computer system, router, peer device, or other common network node, and typically includes many or all the elements described relative to computer system 500. The logical connections, schematically indicated at 550, can include a local area network (LAN) and/or a wide area network (WAN), or a combination of these, and can be in a cloud-type architecture, for example configured as private clouds, public clouds, hybrid clouds, and multi-clouds. When used in a LAN networking environment, computer system 500 can be connected to the local network through a network interface or adapter 552. When used in a WAN networking environment, computer system 500 can include a modem, or can be connected to a communications server on the LAN. The modem, which may be internal or external, can be connected to system bus 506 via an appropriate port interface. In a networked environment, application programs 534 or program data 538 depicted relative to computer system 500, or portions thereof, may be stored in a remote memory storage device 554.

Embodiments disclosed herein include:

A. A method for allocating optimum fluid volume among a set of injectors of a hydrocarbon reservoir, the method comprising:

for each of multiple depletion stages of the reservoir:

determining reservoir pressure at a first region, corresponding to a first injector, in relation to average field reservoir pressure, determining reservoir pressure at a second region, corresponding to a second injector, in relation to average field reservoir pressure, and injecting fluid through the first and second injectors independently and as a function of the determined reservoir pressures at the first and second regions respectively.

B. A hydrocarbon reservoir pressure management system comprising:

a plurality of injectors each associated with at least one region of a field of a hydrocarbon reservoir;

a pressure injection controller configured to receive as inputs physical data and measurement data in connection with the reservoir; and a balancer operable to, at successive reservoir depletion stages:

determine from the physical data and measurement data reservoir pressures at first and second regions in relation to average field reservoir pressure, and independently drive injection volumes of first and second injectors, respectively corresponding to first and second regions, based on the determined reservoir pressures.

C. A machine-readable storage medium having stored thereon a computer program for allocating optimum fluid volume among a set of injectors of a hydrocarbon reservoir, the computer program comprising a routine of set instructions for causing the machine to perform the steps of:

for each of multiple depletion stages of the reservoir:

determining reservoir pressure at a first region, corresponding to a first injector, in relation to average field reservoir pressure, determining reservoir pressure at a second region, corresponding to a second injector, in relation to average field reservoir pressure, and injecting fluid through the first and second injectors independently and as a function of the determined reservoir pressures at the first and second regions respectively.

Each of embodiments A through C may have one or more of the following additional elements in any combination: Element 1: wherein said injection is further a function of the quality and heterogeneity of the reservoir formation. Element 2: wherein said injection is further a function of location and potential of the first and second injectors. Element 3: wherein said injection is further a function of regional reservoir depletion status. Element 4: wherein injection is performed in accordance with a factor f governed by the equation:

$$f = A \times e^{B \times \left(\frac{Pres}{Pswp}\right)^C}$$

where f: is a factor proportional to allocated gas or water injection

A: first pressure balance coefficient

B: second pressure balance coefficient

C: third pressure balance coefficient

Pres: reservoir average pressure

Pswp: static injector well pressure.

Element 5: wherein the fluid is water. Element 6: wherein the fluid brine. Element 7: wherein the fluid gas. Element 8: wherein the fluid is carbon dioxide. Element 9: wherein the fluid is nitrogen.

By way of non-limiting example, exemplary combinations applicable to A through C include: Any combination of Elements 1-4; and any combination of Elements 1-4 with any of Elements 5-9.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method for allocating optimum fluid volume among a set of injectors of a hydrocarbon reservoir, the method comprising:

for each of multiple depletion stages of the hydrocarbon reservoir:

determining reservoir pressure at a first region, corresponding to a first injector, in relation to average field reservoir pressure, determining reservoir pressure at a second region, corresponding to a second injector, in relation to the average field reservoir pressure, and injecting fluid through the first injector and the second injector independently and as a function of the reservoir pressure at the first region and the reservoir pressure at the second region respectively.

2. The method of claim 1, wherein the injecting is further a function of quality and heterogeneity of reservoir formation.

3. The method of claim 1, wherein the injecting is further a function of location and potential of the first injector and the second injector.

4. The method of claim 1, wherein the injecting is further a function of regional reservoir depletion status.

5. The method of claim 1, wherein the injecting is performed in accordance with a factor f governed by equation:

$$f = A \times e^{B \times \left(\frac{Pres}{Pswp}\right)^C}$$

where f: is the factor proportional to allocated gas or water injection,

A: is a first pressure balance coefficient,

B: is a second pressure balance coefficient,

C: is a third pressure balance coefficient,

Pres: is the average field reservoir pressure, and

Pswp: is a static injector well pressure.

6. The method of claim 1, wherein the fluid is water.

7. The method of claim 1, wherein the fluid is brine.

8. The method of claim 1, wherein the fluid is gas.

9. The method of claim 1, wherein the fluid is carbon dioxide.

10. The method of claim 1, wherein the fluid is nitrogen.

11. A hydrocarbon reservoir pressure management system comprising:

a plurality of injectors, each injector associated with at least one region of a field of a hydrocarbon reservoir;

a pressure injection controller configured to receive as inputs physical data and measurement data in connection with the hydrocarbon reservoir; and a balancer operable to, at successive reservoir depletion stages:

determine from the physical data and the measurement data, reservoir pressures at first and second regions in relation to average field reservoir pressure, and independently drive injection volumes of first and second injectors, respectively corresponding to the first and second regions, based on the reservoir pressures.

12. The hydrocarbon reservoir pressure management system of claim 11, wherein the physical data and the measurement data includes quality and heterogeneity of reservoir formation.

13. The hydrocarbon reservoir pressure management system of claim 11, wherein the physical data and the measurement data includes location and potential of the first and second injectors.

14. The hydrocarbon reservoir pressure management system of claim 11, wherein the physical data and the measurement data includes regional reservoir depletion status.

15. The hydrocarbon reservoir pressure management system of claim 11, wherein the balancer drives the injection volumes of the first and second injectors in accordance with a factor f governed by equation:

$$f = A \times e^{B \times \left(\frac{Pres}{Pswp}\right)^C}$$

where f: is the factor proportional to allocated gas or water injection,

A: is a first pressure balance coefficient,

B: is a second pressure balance coefficient,

C: is a third pressure balance coefficient,

Pres: is the average field reservoir pressure, and

Pswp: is a static injector well pressure.

16. A non-transitory machine-readable storage medium having stored thereon a computer program for allocating optimum fluid volume among a set of injectors of a hydrocarbon reservoir, the computer program comprising a routine of set instructions for causing a machine to perform steps of:

for each of multiple depletion stages of the hydrocarbon reservoir:

determining reservoir pressure at a first region, corresponding to a first injector, in relation to average field reservoir pressure, determining reservoir pressure at a second region, corresponding to a second injector, in relation to the average field reservoir pressure, and injecting fluid through the first injector and the second injector independently and as a function of the reservoir pressure at the first region and the second region respectively.

17. The non-transitory machine-readable storage medium of claim 16, wherein the injecting is further a function of quality and heterogeneity of reservoir formation.

18. The non-transitory machine-readable storage medium of claim 16, wherein the injecting is further a function of location and potential of the first injector and the second injector.

19. The non-transitory machine-readable storage medium of claim 16, wherein the injecting is further a function of regional reservoir depletion status.

20. The non-transitory machine-readable storage medium of claim 16, wherein the injecting is performed in accordance with a factor f governed by equation:

$$f = A \times e^{B \times \left(\frac{Pres}{Pswp}\right)^C}$$

where f: is the factor proportional to allocated gas or water injection,

A: is a first pressure balance coefficient,

B: is a second pressure balance coefficient,

C: is a third pressure balance coefficient,

Pres: is the average field reservoir pressure, and

Pswp: is a static injector well pressure.

* * * * *